US009352478B2

(12) United States Patent
Koide

(10) Patent No.: US 9,352,478 B2
(45) Date of Patent: May 31, 2016

(54) CULINARY SLICER

(71) Applicant: KAI R & D CENTER CO., LTD., Gifu (JP)

(72) Inventor: Takashi Koide, Gifu (JP)

(73) Assignee: Kai R & D Center Co., Ltd., Gifu (JP)

( * ) Notice: Subject to any disclaimer, the term of this patent is extended or adjusted under 35 U.S.C. 154(b) by 283 days.

(21) Appl. No.: 13/972,444

(22) Filed: Aug. 21, 2013

(65) Prior Publication Data

US 2014/0060278 A1 Mar. 6, 2014

(30) Foreign Application Priority Data

Aug. 29, 2012 (JP) ..... 2012-188484

(51) Int. Cl.
*B26D 3/28* (2006.01)
*B26D 1/08* (2006.01)

(52) U.S. Cl.
CPC *B26D 3/283* (2013.01); *B26D 1/08* (2013.01); *B26D 2003/286* (2013.01); *Y10T 83/9478* (2015.04)

(58) Field of Classification Search
CPC ..... Y10S 83/932; Y10T 83/9478; Y10T 83/6587; Y10T 83/6588; Y10T 83/659; Y10T 83/6608; Y10T 83/9493; Y10T 83/9495; Y10T 83/9498; Y10T 83/6515; Y10T 83/696; Y10T 83/6531; Y10T 83/6656; Y10T 83/6664; B26D 1/01; B26D 1/02; B26D 1/03; B26D 7/0608; B26D 7/0616; B26D 7/065; B26D 7/26; B26D 7/2638; B26D 2210/02
USPC ..... 30/278, 279.2, 279.6, 280, 281, 283, 30/285, 289, 290; 241/95, 168, 169
See application file for complete search history.

(56) References Cited

U.S. PATENT DOCUMENTS 66,402 A * 7/1867 Schwartz ..... B26D 1/0006 83/856
3,495,639 A * 2/1970 Johansson ..... B26D 1/25 241/95
5,765,472 A 6/1998 Kim
6,732,622 B2 5/2004 Vincent (Continued)

FOREIGN PATENT DOCUMENTS

JP 1-35832 11/1989
JP 2595274 3/1999

OTHER PUBLICATIONS

U.S. Appl. No. 29/443,231, Takashi Koide, filed Jan. 15, 2013.

(Continued)

*Primary Examiner* — Phong Nguyen
(74) *Attorney, Agent, or Firm* — Jordan and Hamburg LLP

(57) ABSTRACT

A slicer with which the thickness of sliced food can be varied includes a movable receiving part that receives sliding food and is subjected to downward pressure from the food, the movable receiving part not moving downward due to the pressure even if a means for securing the receiving part in place is not separately provided. An adjustment member for moving a vertically mobile first receiving part is mounted in a frame of the slicer so as to be forwardly and rearwardly movable. A means for moving the adjustment member is a worm that is provided on a drive shaft. A deflection mechanism is present between the adjustment member and the first receiving part which converts the forward and rearward motion of the adjustment member into vertical motion of the first receiving part.

2 Claims, 14 Drawing Sheets

(56) References Cited

U.S. PATENT DOCUMENTS

| | | | |
|---|---|---|---|
| 6,805,044 | B1 | 10/2004 | Yamamoto |
| D503,314 | S | 3/2005 | Wong |
| D505,301 | S | 5/2005 | Wong |
| 7,066,071 | B2 | 6/2006 | Zeder et al. |
| 7,107,890 | B2 | 9/2006 | Vincent |
| D532,261 | S | 11/2006 | Mellen et al. |
| 7,143,677 | B2 | 12/2006 | Zeder et al. |
| D559,635 | S | 1/2008 | Wong |
| D574,675 | S | 8/2008 | Debuyer |
| D578,836 | S | 10/2008 | Hood |
| D581,221 | S | 11/2008 | Hull |
| 7,621,207 | B2 | 11/2009 | Botsai et al. |
| D608,162 | S | 1/2010 | Mah et al. |
| D618,066 | S | 6/2010 | De Buyer et al. |
| 7,866,243 | B2 | 1/2011 | DiPietro |
| D650,642 | S | 12/2011 | Fung |
| 8,069,766 | B2 | 12/2011 | de Buyer et al. |
| D651,483 | S | 1/2012 | Bagley |
| D651,868 | S | 1/2012 | Thornton |
| 2004/0231482 | A1 | 11/2004 | Boilen |
| 2006/0075872 | A1 | 4/2006 | Wangler |
| 2006/0283299 | A1 | 12/2006 | Mellen et al. |

OTHER PUBLICATIONS

U.S. Appl. No. 29/443,231, filed Jan. 15, 2013, Koide.

* cited by examiner

CULINARY SLICER

TECHNICAL FIELD

The present invention relates to a culinary slicer that can be used for household purposes or for professional purposes, and which allows the thickness of the food that is sliced to be adjusted.

BACKGROUND OF THE INVENTION

Culinary slicers are configured so that, by sliding food forward from the top face of a first receiving part to the top face of a second receiving part, the food is sliced by a slicing blade that is mounted at the boundary between the first receiving part and the second receiving part. Next, in order to adjust the thickness of the food that is sliced, a configuration is adopted in which, for example, the first receiving part is movably mounted, and the height of the first receiving part is changed with respect to the slicing blade. In the slicer in Patent Document 1, in order to make the first receiving part movable, a bottom inclined face of a movable sliding plate, which is the first receiving part, and the inclined face of an adjustment body, which is an adjustment member, face each other so as to be able to slide on each other, and the movable sliding plate can be vertically translated by moving the adjustment body forward and rearward. This slicer is not provided with a securing means to prevent the movable adjustment body from being moved downward as a result of the pressure exerted by food during use. This is because, since the angle of inclination of the two facing inclined faces is small, the force that acts in the direction that would cause the two inclined faces to slide when subjected to pressure from the food is not great enough to overcome the friction between the inclined faces and cause sliding. Thus, an adjustment body securing means is not necessary for the slicer in Patent Document 1, but because the angle of inclination of the two facing inclined faces is small, the amount of a vertical movement of the movable sliding plate that can be brought about by the forward and rearward movement of the adjustment body is slight. Accordingly, the thickness of the sliced food can only be adjusted in a small range. If one wished to adjust the food thickness over a wide range, this would necessitate a great amount of forward and rearward movement of the adjustment body. Thus, in order to increase the travel of the adjustment body, the length of the slicer would have to be correspondingly increased, and the slicer would become unduly long.

In order to allow a wide range of adjustment for the thickness of the food, without increasing the length of the slicer in Patent Document 1, one could increase the angle of inclination of the two facing inclined faces, but without the securing means mentioned above, the first receiving part would move downward during use due to the pressure exerted by the food. Patent Document 2 describes a configuration in which the two facing inclined faces are at a large angle so that, without unduly increasing the length of the slicer, the adjustable receiving plate, which is the first receiving part, has a wide range of vertical movement, and thus the thickness of the food can be adjusted over a wide range. However, without a securing means, the adjustable receiving plate will move downward during use, and therefore the adjustable receiving plate is secured with a screw. If the adjustable receiving plate is secured with a screw in this manner, the screw must be loosened when one moves the adjustable receiving plate and the screw must be tightened in order to secure the adjustable receiving plate after moving it, so that each time that one changes the thickness of the food, the screw must be loosened and tightened, which makes work troublesome.

PRIOR ART DOCUMENTS

Patent Documents

Patent Document 1: JP-2595274-Y1
Patent Document 2: JP-01-35832-U

SUMMARY OF THE INVENTION

An object of the invention is to provide a slicer with which the thickness of the food that is sliced can be varied, and with which, even if a means for securing a movable receiving part that receives the sliding food is not provided, when the movable receiving part is subjected to pressure from above, the receiving part does not move downward due to that pressure.

The invention relates to a culinary slicer capable of slicing, with a slicing blade, food that slides forward along the top face of a first receiving part to the top face of a second receiving part, and with which the thickness of the sliced food can be adjusted by way of moving at least one of the slicing blade and the first receiving part so as to change the relative heights thereof, the slicer being configured such that an adjustment member for moving a mobile first receiving part and/or the slicing blade is movably mounted in a slicer frame, and such that a means for moving the adjustment member is a worm provided on a drive part.

The invention is configured such that the first receiving part is mobile in a manner that varies the height thereof with respect to the slicing blade, and a deflection mechanism is present between the adjustment member and the first receiving part, which converts the motion of the adjustment member into motion that changes the height of the first receiving part with respect to the slicing blade.

The invention is configured such that the first receiving part is capable of vertical translation.

The invention is configured such that the adjustment member can move forward and rearward.

The invention is configured such that the worm extends in the longitudinal direction.

The invention is configured such that the deflection mechanism comprises inclined faces provided on the first receiving part and the adjustment member, which are inclined in the vertical direction, the inclined faces facing each other and being able to slide on each other.

The invention is a culinary slicer capable of slicing, with a slicing blade, food that slides forward along the top face of a first receiving part to the top face of a second receiving part, and with which the thickness of the sliced food can be adjusted by way of moving the first receiving part so as to change the relative heights of the first receiving part and slicing blade, configured such that an adjustment member for moving the first receiving part is movably mounted in a slicer frame; such that a means for moving the adjustment member is a worm provided on a drive part; and further such that a deflection mechanism is present between the adjustment member and the first receiving part, for converting the motion of the adjustment member into motion that changes the height of the first receiving part with respect to the slicing blade, the deflection mechanism comprising inclined faces provided on the first receiving part and the adjustment member, which are inclined in the vertical direction, the inclined faces facing each other and being able to slide on each other.

The invention is configured such that the deflection mechanism is a deflection mechanism combining: a deflection mechanism comprising inclined faces provided on the first receiving part and the adjustment member, which are inclined in the vertical direction, the inclined faces facing each other and being able to slide on each other; and a deflection mechanism wherein an inclined groove, which is inclined in the vertical direction, is formed on either one of the first receiving part or the adjustment member, and an engagement part that engages in the inclined groove is provided on the other of the first receiving member and the adjustment member.

An adjustment member for moving a mobile first receiving part and/or the slicing blade is movably mounted in a slicer frame, and the means for moving the adjustment member is a worm provided on a drive part. The worm is used as a mechanism component in a drive transmission mechanism, and has a self-locking function; the first receiving part or the slicing blade, which are movable members, can be moved from the driving side (worm) but, conversely, if one attempts to turn the worm from the movable member side, the worm will not turn. That is to say, the worm functions as both a drive transmission means and a securing means. Accordingly, when the movable member is subjected to downward pressure exerted by the food, the movable member will not move downward, even if a means for securing the movable member is not separately provided. Consequently, when changing the thickness of the sliced food, it suffices to turn the worm, without the need for tightening or loosening screws or the like that serve as means for securing the movable member, and thus adjusting the thickness of the sliced food is not bothersome.

The first receiving part is mobile in a manner that varies the height thereof with respect to the slicing blade, and a deflection mechanism is present between the adjustment member and the first receiving part, which converts the motion of the adjustment member into motion that changes the height of the first receiving part with respect to the slicing blade. Supposing that the configuration was such that the first receiving part was fixed in place and the slicing blade was moved so as to vary the height thereof, because it would be necessary for both the slicing blade and the second receiving part to be moved in the same manner, the configuration would be complex. With the configuration in which the first receiving part is moved, the slicing blade and the second receiving part are fixed in place and only one member is moved, which allows for a configuration that is simpler than a configuration in which the slicing blade is moved.

The first receiving part is capable of vertical translation. Supposing that the first receiving part were translated at an angle, it would be necessary for the frame of the slicer to be made correspondingly longer. If the first receiving part is made capable of vertical translation, there is no displacement of the first receiving part in the forward or rearward direction, and therefore there is no need for the frame to be made unduly long.

The adjustment member can move forward and rearward. The configuration that allows for forward and rearward movement of the adjustment member when the adjustment member is mounted in the frame is the simplest configuration.

The worm extends in the longitudinal direction. The slicer frame is formed so as to be longer in the forward-rearward direction than in the crosswise direction. Accordingly, even if the drive part that includes the worm is long, this can easily be mounted in the frame.

The deflection mechanism comprises inclined faces provided on the first receiving part and the adjustment member, which are inclined in the vertical direction, the inclined faces facing each other and being able to slide on each other. With this deflection mechanism, by moving the adjustment member, the first receiving part can be moved so as to change the height of the first receiving part with respect to the slicing blade.

An adjustment member for moving the first receiving part is movably mounted in a slicer frame; a means for moving the adjustment member is a worm provided on a drive part; and further, a deflection mechanism is present between the adjustment member and the first receiving part, for converting the motion of the adjustment member into motion that changes the height of the first receiving part with respect to the slicing blade, the deflection mechanism comprising inclined faces provided on the first receiving part and the adjustment member, which are inclined in the vertical direction, the inclined faces facing each other and being able to slide on each other. By virtue of this configuration, the adjustment member is moved by way of turning the worm by operating a drive part, and the movement of the adjustment member is converted into a movement that changes the height of the first receiving part with respect to the slicing blade, whereby the thickness of the sliced food can be adjusted.

The deflection mechanism is a deflection mechanism combining: a deflection mechanism comprising inclined faces provided on the first receiving part and the adjustment member, which are inclined in the vertical direction, the inclined faces facing each other and being able to slide on each other; and a deflection mechanism wherein an inclined groove, which is inclined in the vertical direction, is formed on either one of the first receiving part or the adjustment member, and an engagement part that engages in the inclined groove is provided on the other of the first receiving member and the adjustment member. If a configuration is adopted for the deflection mechanism wherein the first receiving part and the adjustment member simply have inclined faces that are inclined in the vertical direction and these inclined faces face each other and are able to slide on each other, it is possible that the movement of the first receiving part will not be smooth. That is to say, when the first receiving part is raised, the bottom inclined face of the facing inclined faces pushes on the top inclined face so that the top inclined face is raised by the force that pushes it. However, when the first receiving part is lowered, the bottom inclined face moves in a direction that separates it from the top inclined face and therefore, if it does not move downward spontaneously, the first receiving part will be left behind. In this case, there is the bothersome necessity of pushing down on the first receiving part so as to forcibly move it downward. Here, when the deflection mechanism combines a deflection mechanism using an engagement part that engages in an inclined grove, the first receiving part can reliably be moved downward by the combined deflection mechanism. With the combined deflection mechanism, the first receiving part can be reliably raised and lowered, but with a deflection mechanism consisting only of the engagement of the inclined groove and the engagement part, there would be a risk of damage when raising the first receiving part due to the inferior strength of the engagement part. Here, by combining a deflection mechanism in which the inclined faces face each other and are able to slide on each other, the deflection mechanisms can mutually compensate for these disadvantages.

DESCRIPTION OF THE PREFERRED EMBODIMENTS

Figure 1:
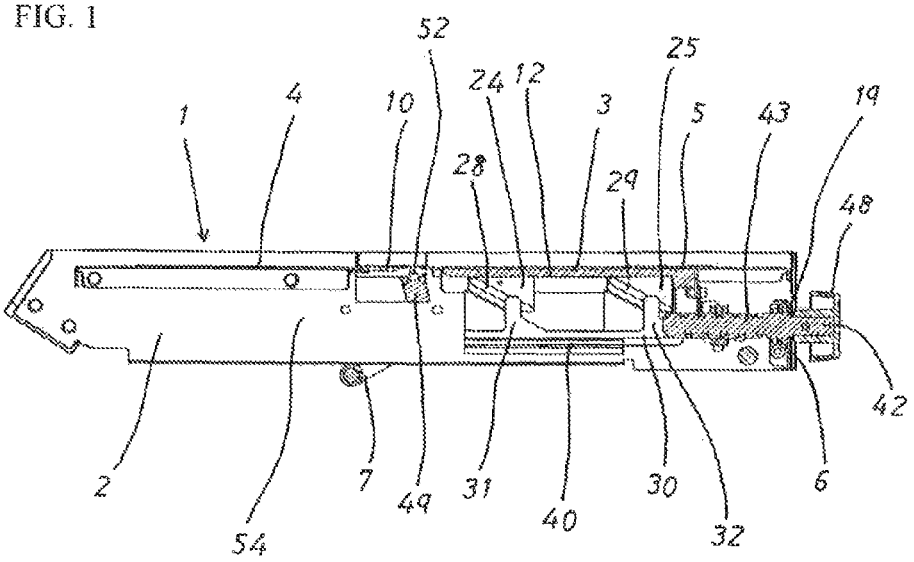
FIG. 1 is a longitudinal sectional view of the present invention.
Figure 2:
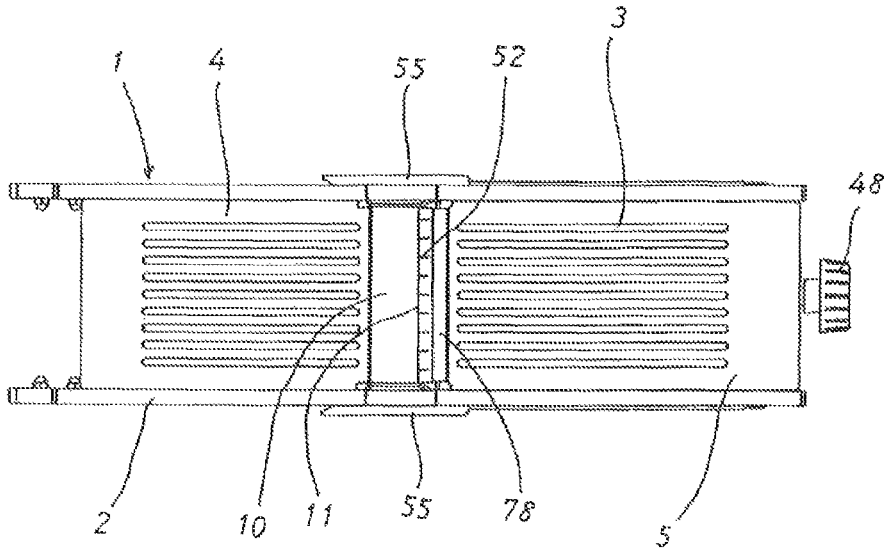
FIG. 2 is a plan view of the present invention.
Figure 3:
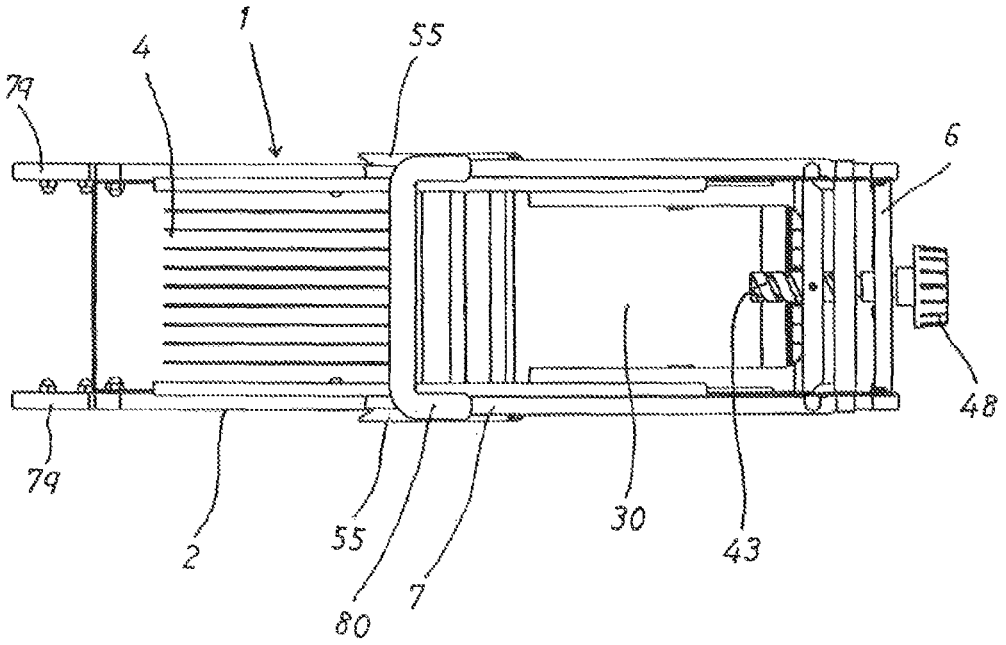
FIG. 3 is a bottom view of the present invention.

Embodiments of the present invention will be described. As shown in FIG. 1, the slicer 1 of the present invention comprises a frame 2, a first receiving part 3 and a second receiving part 4. The frame 2 and the second receiving part 4 are made from stainless steel sheets. The first receiving part 3 comprises a base member 12 made from plastic and a top plate 5 made from a stainless steel sheet. The first receiving part 3 is capable of perpendicular translation in the vertical direction, which allows the thickness of the sliced food to be adjusted. The second receiving part 4 is secured to the frame 2.

Figure 4:
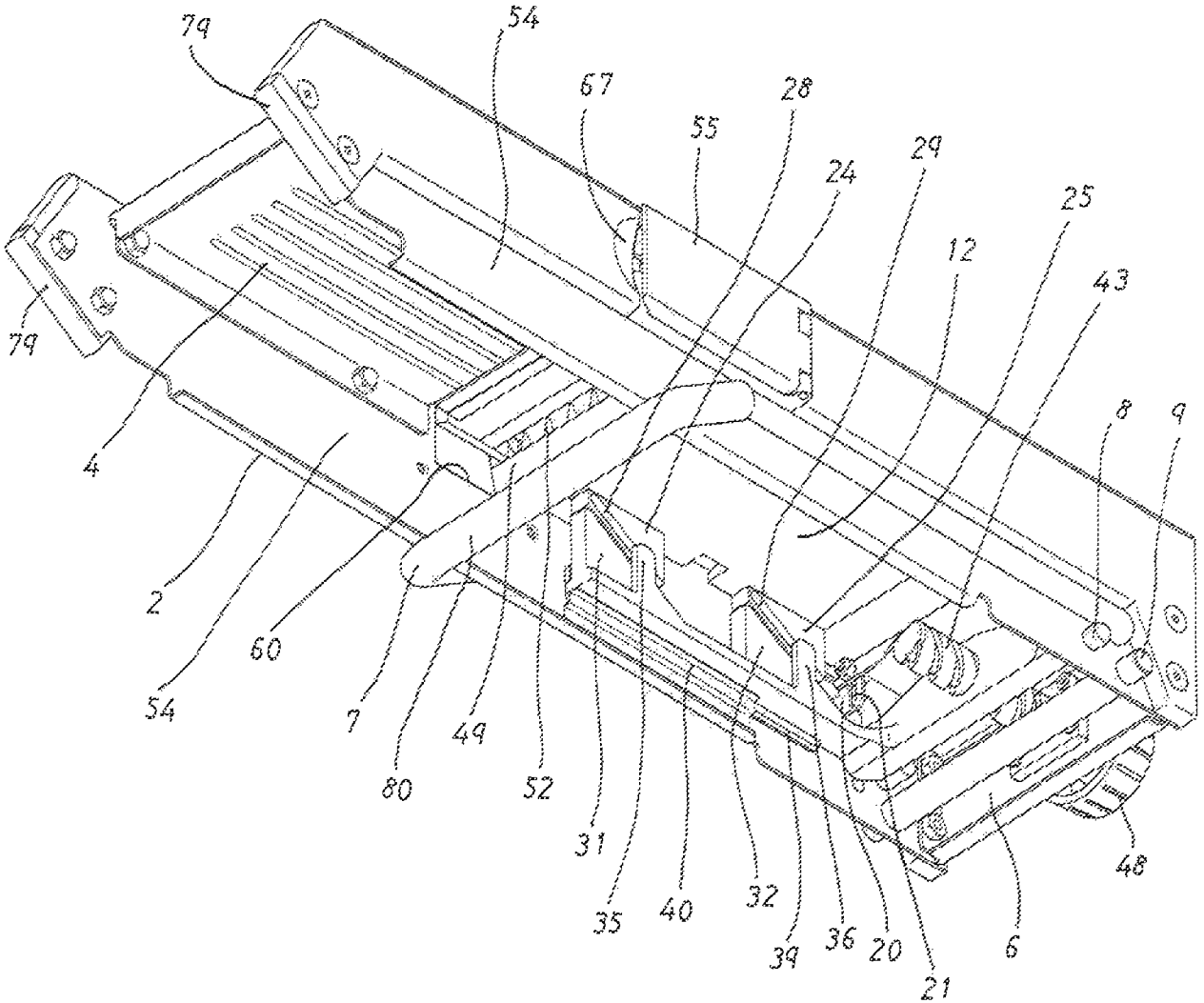
FIG. 4 is a perspective view of the present invention seen from the bottom side.
Figure 5:
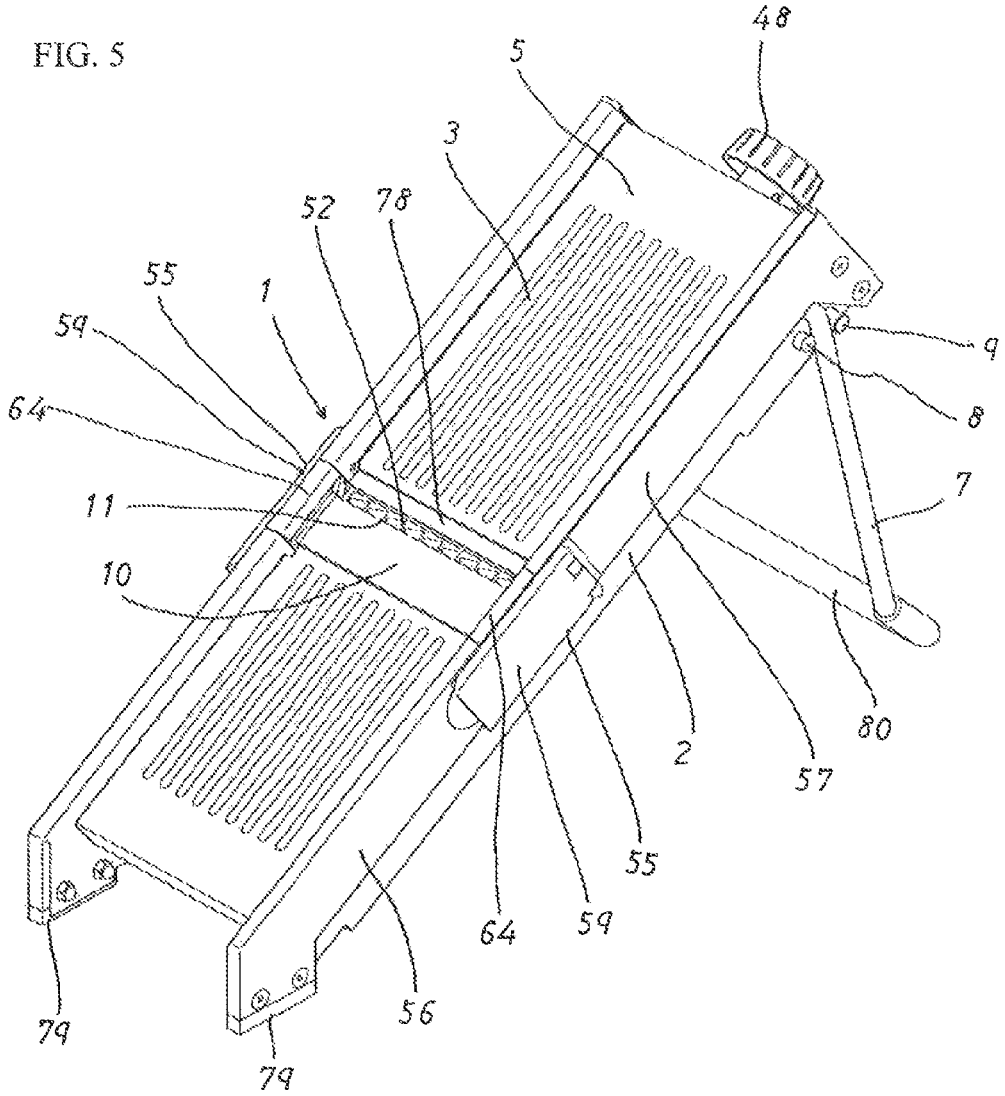
FIG. 5 is a view of the manner in which the present invention is used.

As shown in FIG. 4, a stand 7 is turnably mounted on the frame 2, and is kept closed when not in use by way of engagement on an engagement protrusion 8. As shown in FIG. 5, when in use, the stand 7 is opened by way of turning it and, with this maintained at a prescribed angle of opening by way of a stopper 9, the slicer 1 can be used in an inclined state. Furthermore, contact parts 79, 79 are provided at the forward end of the frame 2 and an anti-slip part 80 is provided on the crosswise-extending contact part of the stand 7, so that stable slicing operations can be performed by virtue of these contact parts 79, 79 and the anti-slip part 80. Furthermore, the slicer 1 comprises a flat slicing blade 10. The slicing blade 10 is detachably mounted so that the blade edge 11 is oriented rearward, which is to say in the direction of the adjustment knob 48. The food to be sliced is sliced by the slicing blade 10 as a result of sliding forward on the top face of the receiving part 3, which is to say in the direction opposite to the adjustment knob 48, whereafter a single slice operation is completed by sliding forward on the top face of the second receiving part 4. By repeating this slicing operation, food can be produced that has been sliced into many slices.

Figure 6:
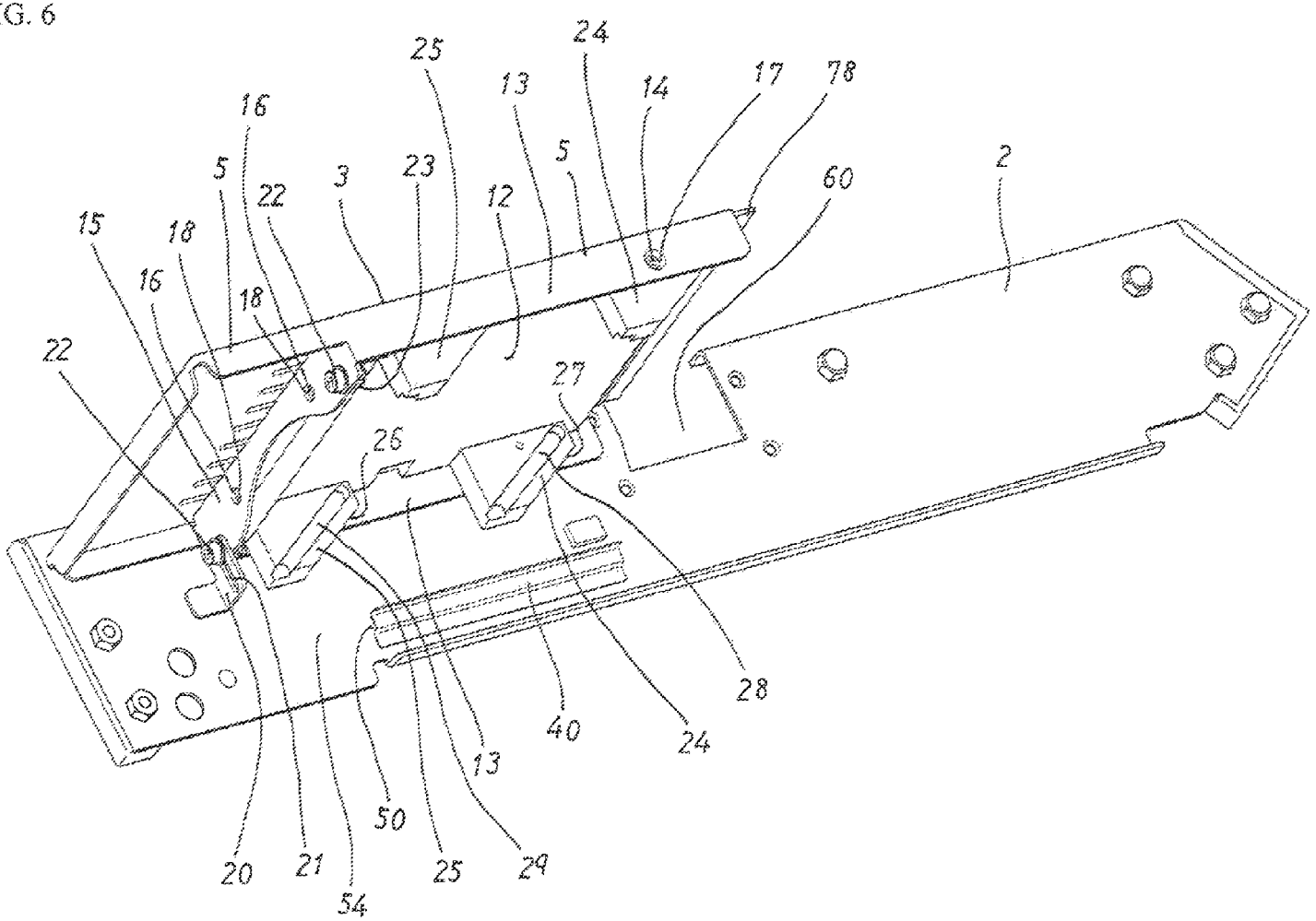
FIG. 6 is a partial perspective view showing the connection between the side wall of the frame and the first receiving part.
Figure 7:
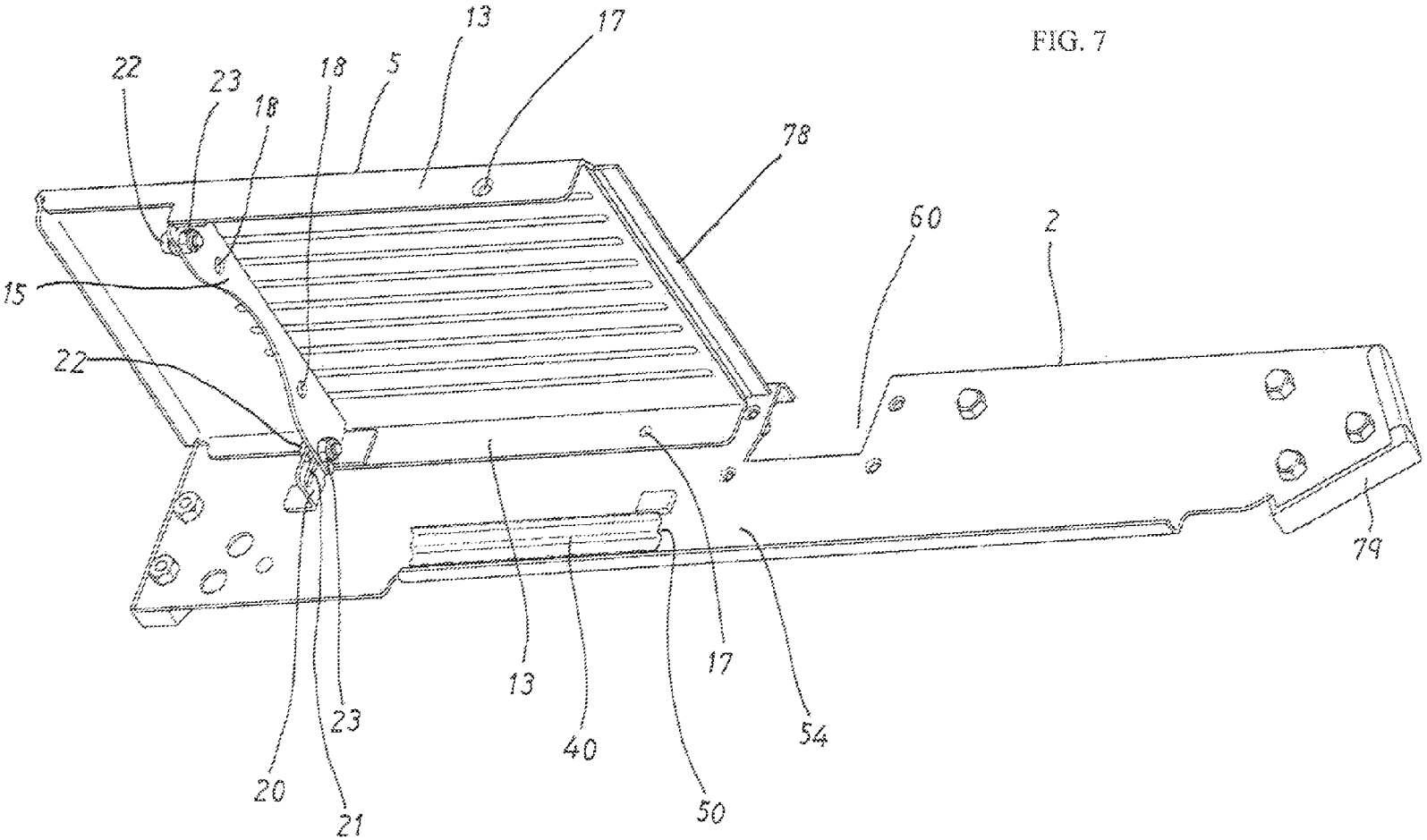
FIG. 7 is a partial perspective view showing the connection between the side wall of the frame and the first receiving part.

Next, a description will be given of the deflecting mechanism, which converts the horizontal movement of the adjustment member 30, which is the driving body, to perpendicular vertical movement of the first receiving part 3, which is the follower. As shown in FIG. 6, the first receiving part 3 is such that a top plate 5 is secured to the top face of a plastic base member 12. As shown in FIG. 7, the top plate 5 is integrally provided with two sidewalls 13, 13 between which the base member 12 is to be positioned, in addition to which a separate guide plate 15 is mounted extending perpendicular thereto. Furthermore, pinholes 17, 17 are provided in the two side walls 13, 13 for fastening the base member 12, which is positioned therebetween, and pinholes 18, 18 are provided in the guide plate 15. As shown in FIG. 6, the base member 12 fits into a space formed between the two side walls 13, 13 and the guide plate 15, and the two side walls 13, 13 and the base member 12 are joined by pins 14, which pass through the pinholes 17, 17 while the guide plate 15 and the base member 12 are joined by pins 16, 16, which pass through the pinholes 18, 18.

The guide plate 15 is provided with a pair of bolt holes (not shown) through which bolts 22 are inserted, exterior to the pinholes 18, 18. Furthermore, a pair of brackets 20 (one of which is not shown), which are formed with an L-shaped bend, are secured to the inner faces of two side walls 54, 54 of the frame 2. The brackets 20 are provided with vertically extending slots 21. These slots 21 define the maximum range of motion of the first receiving part 3. The bolts 22, 22 are inserted through the bolt holes in the guide plate 15 and the slots 21 in the brackets 20, and the bolts 22, 22 are prevented from coming out of the bolt holes and the slots 21 by way of passing through washers and being screwed into nuts 23, 23. Note that the nuts 23, 23 are not completely tightened, but rather are tightened so as to allow movement of the bolts 22, 22 in the slots 21. The first receiving part 3 moves vertically with respect to the frame 2 by way of the vertical movement of the bolts 22, 22 in the slots 21. Additionally, forward and rearward movement of the first receiving part 3 is restricted by surface contact between the brackets 20 and the guide plate 15. This configuration is essential for allowing vertical perpendicular translation of the base member 12.

Figure 8:
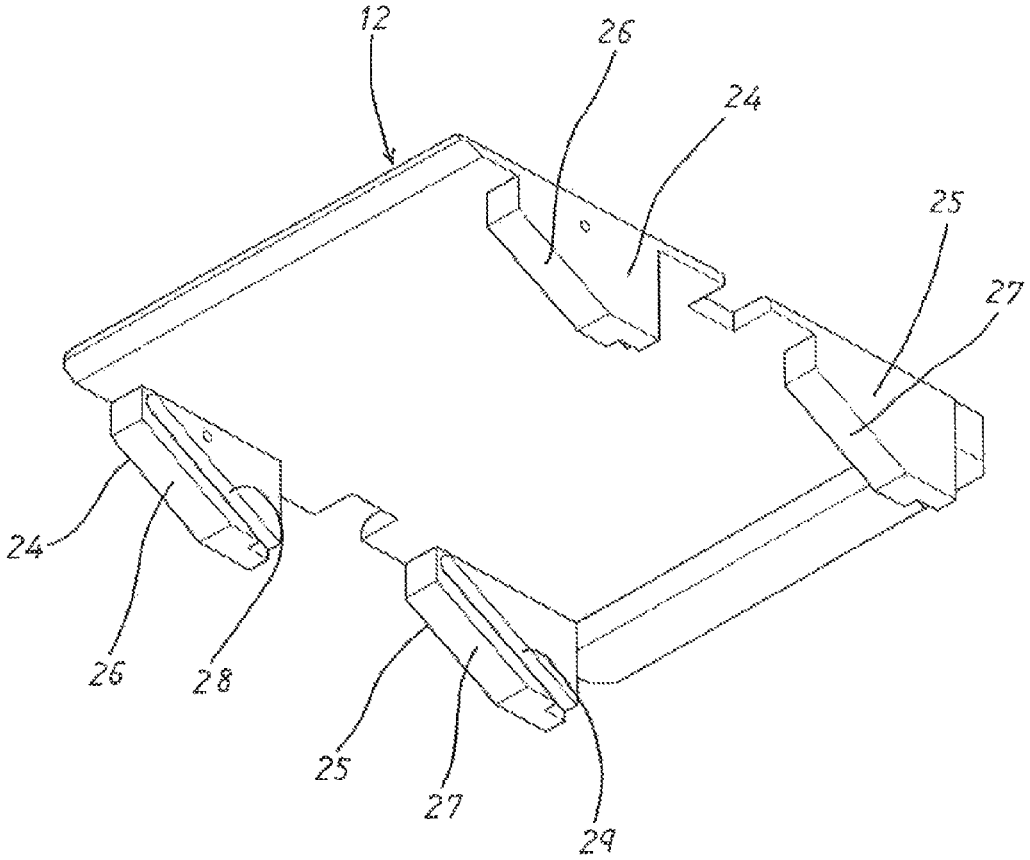
FIG. 8 is a perspective view seen from the underside of the base member.

As shown in FIG. 8, two front and rear pairs of follower parts 24, 24, 25, 25 are integrally provided on the two sides of the bottom face of the base member 12. Furthermore, each of the follower parts 24, 24, 25, 25 has follower inclined faces 26, 26, 27, 27 on the respective bottom faces thereof. The follower inclined faces 26, 26, 27, 27 are formed as inclined faces that rise from the rear to the front of the slicer 1. Moreover, each of the follower parts 24, 24, 25, 25 has follower inclined grooves 28, 29 on the respective inner faces thereof, which are parallel to the follower inclined faces 26, 26, 27, 27.

Figure 9:
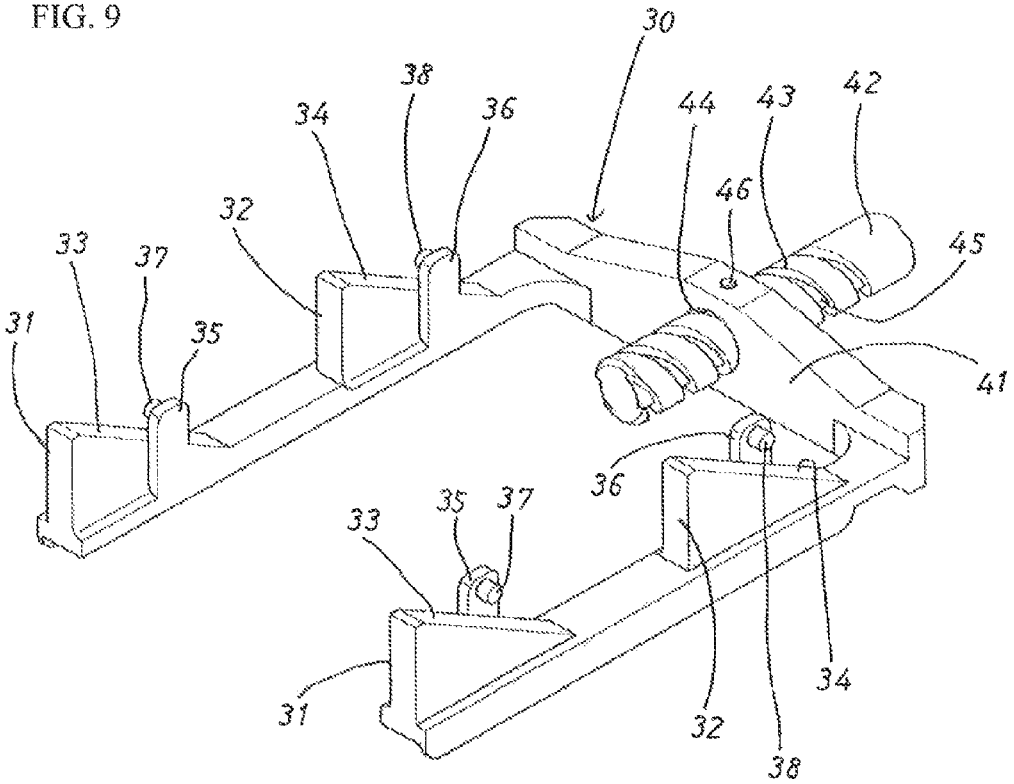
FIG. 9 is a perspective view seen from the top side of the adjusting member.

Moreover, the slicer 1 has an adjustment member 30, which is the driving body that applies the force that moves the base member 12 described above. As shown in FIG. 9, two front and rear pairs of driving parts 31, 31, 32, 32 are integrally provided on the two sides of the top face of the adjustment member 30. Furthermore, each of the driving parts 31, 31, 32, 32 has a driving inclined face 33, 33, 34, 34 on the respective top face thereof. These driving inclined faces 33, 33, 34, 34 are formed as inclined faces that rise from the rear to the front of the slicer 1, at the same angle as the follower inclined faces 26, 26, 27, 27 described above. When the first receiving part 3 and the adjustment member 30 are arranged in the frame 2, the driving inclined faces 33, 33, 34, 34 and the follower inclined faces 26, 26, 27, 27 face each other and can slide on each other.

Furthermore, projecting pieces 35, 35, 36, 36 stand upright from the driver pieces 31, 31, 32, 32 of the adjustment member 30 and driving engagement projections 37, 37, 38, 38 are formed at the top of these projecting pieces 35, 35, 36, 36 so as to project above the driving inclined faces 33, 33, 34, 34.

When the first receiving part 3 and the adjustment member 30 are arranged in the frame 2, with the driving inclined faces 33, 33, 34, 34 in contact with the follower inclined faces 26, 26, 27, 27, the driving engagement protrusions 37, 37, 38, 38 engage in the two front and rear pairs of follower inclined grooves 28, 29 in the base member 12.

Furthermore, guide parts 40 made from stainless steel sheet (one of which is not illustrated) are secured by way of welding to the inner faces of the two side walls 54, 54 of the frame 2, and serve to guide the forward and rearward movement of the adjustment member 30, while supporting the adjustment member 30. A guide groove 50 is configured in the guide part 40, in cooperation with the side wall 54 of the frame 2. Elongate protrusions 39, 39, which extend in the longitudinal direction and engage in the guide grooves 50, are formed on the two sides of the bottom face of the adjustment member 30. When the adjustment member 30 is arranged in the frame 2, the elongate protrusions 39, 39 of the adjustment member 30 engage in the guide grooves 50 so that the forward and rearward movement of the adjustment member 30 is guided by the guide groove 50.

Furthermore, a worm 43 that forms a helical groove 45 provided on a drive shaft 42, which is a drive part, is inserted into an engagement hole 44 provided in a rear wall 41 of the adjustment member 30 so as to be rotatable around the axis of the same. Next, a pin 46 that has been inserted via the top face of the back wall 41 engages in the groove 45 of the worm 43. The worm 43 can be turned with the pin 46 and the groove 45 engaged. The drive shaft 42, which comprises the worm 43, is inserted into a shaft hole 19 that is provided in a rear end wall 6 of the frame 2, and supported so as to be immobile in the forward and rearward directions. The worm 43 can be turned by turning the adjustment knob 48 that is provided at the rear end of the drive shaft 42. Because the worm 43 is supported so as to be immobile in the forward and rearward directions, only the adjustment member 30 moves in the forward and rearward directions with respect to the frame 2 as a result of the worm 43 being turned.

Figure 10:
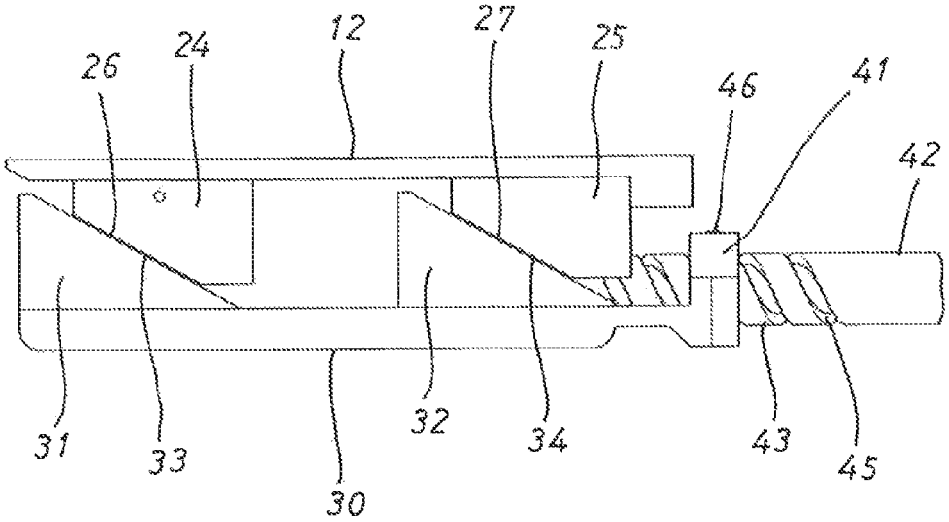
FIG. 10 is a side view showing the relationship between the base member and the adjusting member.

Next, the method of moving the first receiving part 3 perpendicularly upward will be described with reference to FIG. 10. Starting from the situation in FIG. 10, if the drive shaft 42 is turned in the clockwise direction around the axis thereof, the adjustment member 30 moves rearward (to the right). At this time, the driving inclined faces 33, 34 press on the follower inclined faces 26, 27, whereby not only is a lifting force applied to the base member 12 of the first receiving part 3, but a rearward moving force is also applied. However, as shown in FIG. 6, due to the surface contact between the guide plate 15 of the first receiving part 3 and the brackets 20 that are provided on the inner faces of the two side walls 54, 54 of the frame 2, forward and rearward movement of the base member 12 is prevented so that the first receiving part 3 does not move rearward. Accordingly, the first receiving part 3 rises only perpendicularly while the driving inclined faces 33, 34 and the follower inclined faces 26, 27 slide against each other. Furthermore, because the forward follower part 24 and the rearward follower part 25 have the same shape, and the forward driving part 31 and the rearward driving part 32 have the same shape, the forward and rearward lifting of the base member 12 are equal, so that the first receiving part 3 translates perpendicularly. Furthermore, as differs from a screw, with the worm 43, the spacing on the normal line between grooves is large, so that the adjusting member 30 can be rapidly moved with minimal turning of the worm 43. Furthermore, when the first receiving part 3 reaches a prescribed height, in the present invention there is no locking mechanism for maintaining the first receiving part 3 at that height. This is because the worm has a self-locking function so that even if pressure is applied to the first receiving part 3 from above, the worm will not turn in reverse, and thus the first receiving part 3 will not move downward. Accordingly, in the present invention, a locking mechanism for maintaining the first receiving part 3 at a predetermined height is unnecessary.

Figure 11:
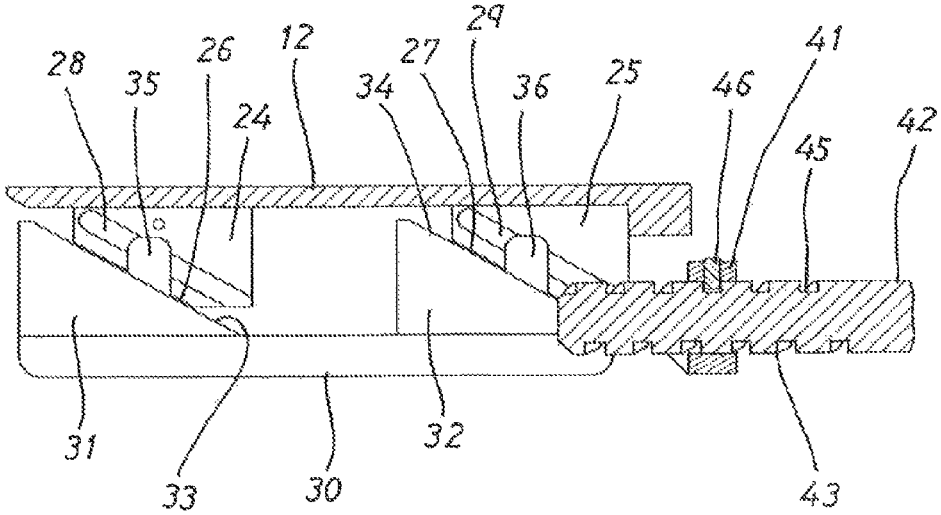
FIG. 11 is a side view showing the relationship between the base member and the adjusting member.

Next, the method of moving the first receiving part 3 perpendicularly downward is described with reference to FIG. 11. Starting from the situation in FIG. 11, if the drive shaft 42 is turned counterclockwise around the axis thereof, the adjustment member 30 moves forward (to the left). Consequently, the driving inclined faces 33, 34 of the adjustment member 30 move in the direction that gradually decreases the heights at which the follower inclined faces 26, 27 of the base member 12 are maintained. Together with this movement, the driving engagement protrusions 37, 38 of the driving part 31, 32, which are engaged in the follower inclined grooves 28, 29 of the follower parts 24, 25, press against the lower inner faces of the follower inclined grooves 28, 29 and force downward the first receiving part 3, the motion of which in the forward and rearward directions is prevented. Supposing that the driving engagement protrusions 37, 38 and the follower inclined grooves 28, 29 were not engaged, when the driving inclined faces 33, 34 of the adjustment member 30 moved in the direction that gradually decreases the height at which the follower inclined faces 26, 27 of the base member 12 are maintained, even if the first receiving part 3 were able to move downward spontaneously under its own weight, when there is a large amount of friction between the frame 2 and the first receiving part 3, there is a risk that the first receiving part 3 would be left behind without spontaneously moving downward. Thus, in this embodiment, two deflection mechanisms are provided in combination for moving the first receiving part 3, which is the follower body, upward and downward as a result of moving the adjustment member 30, which is the driving body, forward and rearward, these being a deflection mechanism wherein the inclined faces that are provided on the first receiving part 3 and the adjustment member 30 are able to slide against each other, and a deflection mechanism wherein the driving engagement protrusions 37, 38 that are provided on the adjustment member 30 and the follower inclined grooves 28, 29 that are provided in the first receiving part 3 engage. These mechanisms thus allow reliable vertical movement of the first receiving part 3 in keeping with the turning of the adjustment knob 48 and the forward and rearward movement of the adjustment member 30. Furthermore, when the first receiving part 3 is moved to the highest position, the top face of the first receiving part 3 is set higher than the slicing blade 10, which is safe in that there is no risk of fingers or the like being hurt by the slicing blade 10, and damage to the blade can also be prevented. Moreover, by virtue of the engagement of the driving engagement protrusions 37, 38 and the follower inclined grooves 28, 29, the driving inclined faces 33, 34 and the follower inclined faces 26, 27 will not separate, which makes it possible to prevent the end of the first receiving part 3 from floating or jumping up during use.

Figure 12:
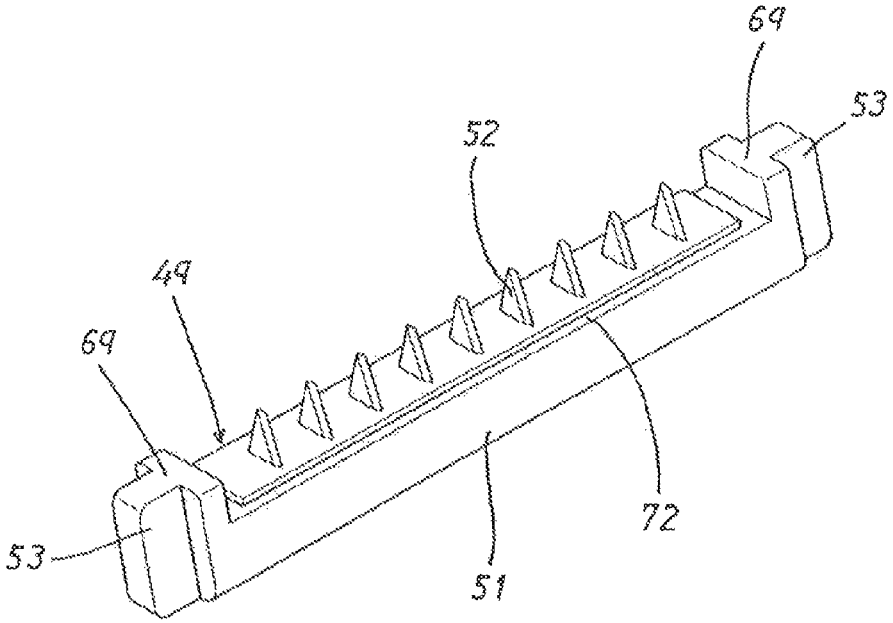
FIG. 12 is a perspective view of the comb-tooth unit.

In this embodiment, food can be sliced by the slicing blade 10, but by detachably mounting a comb-tooth unit 49 shown in FIG. 12 in the frame 2, the food can be julienned. The comb-tooth unit 49 is configured by aligning a multiplicity of comb teeth 52 on a bar shaped base 51. Stop protrusions 53, 53 are formed at the two ends of the base 51. Moreover, a step 72 is formed by providing a height differential along the longitudinal direction of the base 51. This step 72 determines the lower boundary of the first receiving part 3. That is to say, the height differential of the step 72 is equal to the thickness of the top plate 5 of the first receiving part 3. Thus, when the first receiving part 3 is lowered, the forward end 78 of the top plate 5 strikes against the step 72 of the comb-tooth unit 49, so that the first receiving part 3 is prevented from lowering any further. When food is julienned in this state, the thickness of the slices and the pitch between the comb teeth are the same, so that the cross-section of the julienned food is square. When julienning with the first receiving part 3 raised higher than this, the cross-section of the food will be rectangular. Furthermore, by providing a plurality of comb-tooth units 49, in which the heights and pitches of the comb teeth 52 are different, it is possible to julienne at different sizes.

Figure 14:
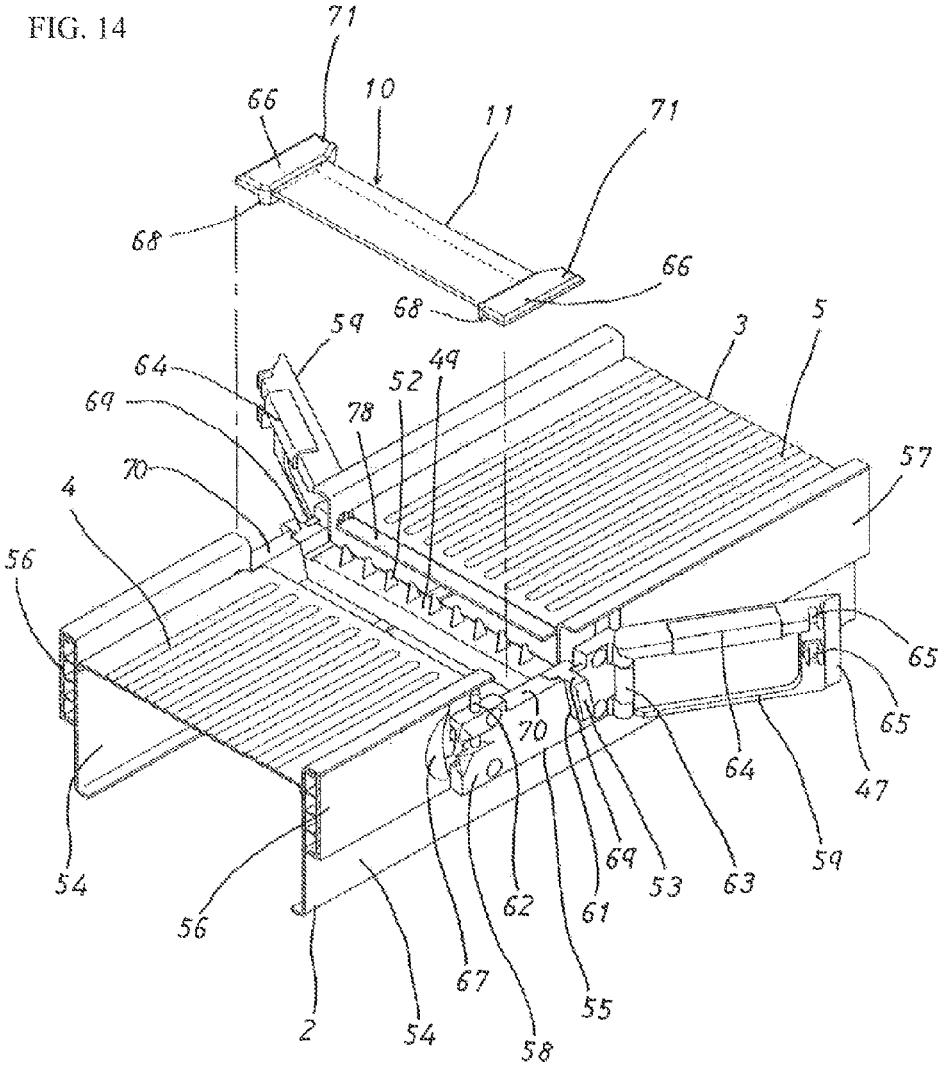
FIG. 14 is a exploded view of the portion of the slicer where the slicing blade and the comb-tooth unit are mounted.
Figure 15:
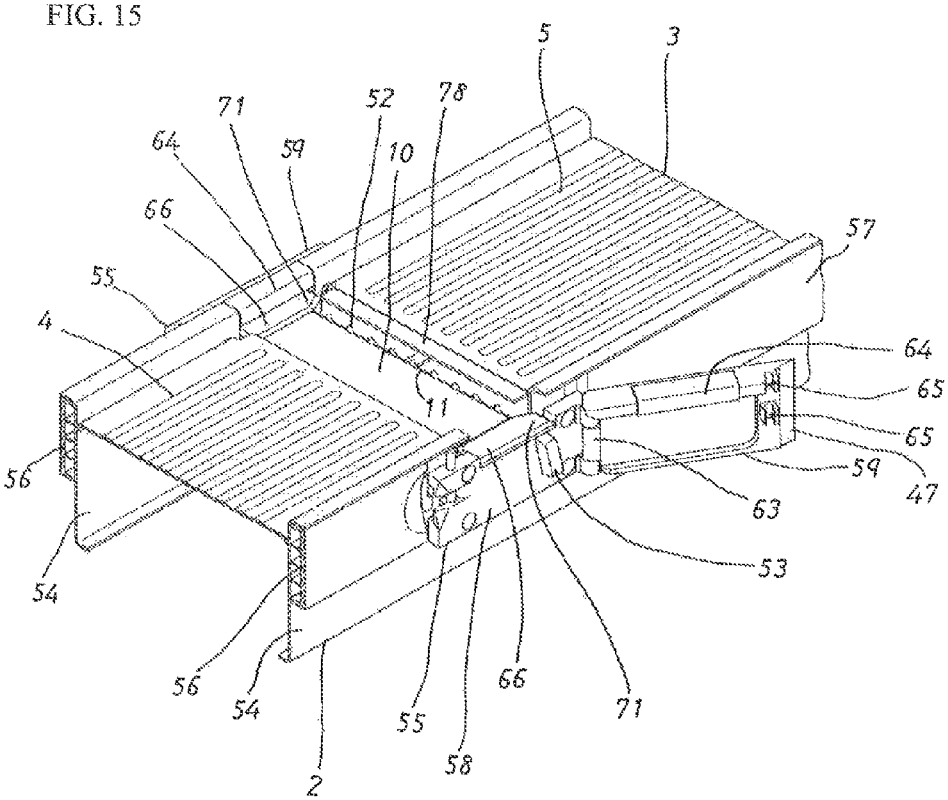
FIG. 15 is a partial perspective view showing the situation in which the slicing blade and the comb-tooth unit have been mounted.

Next, the configuration for detachably mounting the slicing blade 10 and the comb-tooth unit 49 in the frame 2 is described. As shown in FIG. 14, the slicing blade 10 has horizontal plates 66, 66 at the two ends thereof for detachable mounting in the frame 2. The horizontal plates 66, 66 have extended portions 71 which protrude beyond the blade edge 11 of the slicing blade 10. Furthermore, elongate engagement protrusions 68, 68 are formed to the interior of the bottom face of the horizontal plates 66, 66. The elongate engagement protrusions 68, 68 are formed so that, when mounted in the frame 2, the slicing blade 10 is prevented from moving in the longitudinal direction. Furthermore, as shown in FIG. 15, locking members 55, 55, which serve to prevent the slicing blade 10 and the comb-tooth unit 49 that have been mounted in the frame 2 from coming out, are mounted near the center of the outer faces of the two side walls 54, 54 of the frame 2. Moreover, on the outer faces of the two side walls 54, 54 of the frame 2, to the fore and to the rear of the locking members 55, 55, first outer walls 56, 56 are mounted, which are made from plastic and extend in the longitudinal direction to the fore thereof, and second outer walls 57, 57 are mounted, which are made from plastic and extend in the longitudinal direction to the rear thereof. Note that, with regard to the frame 2, 2, the locking members 55, 55 and the like, as these are symmetrically present on the two sides of the frame 2, hereafter, only one side will be described.

Figure 13:
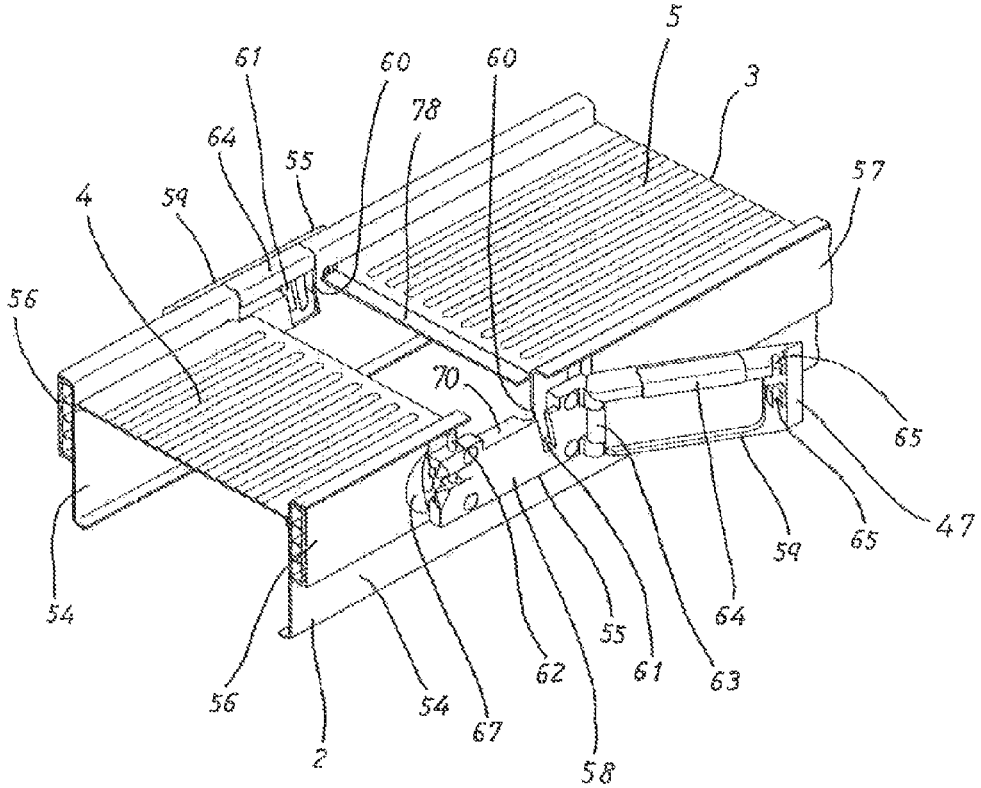
FIG. 13 is a perspective view of a portion of the slicer where the slicing blade and the comb-tooth unit are mounted.

As shown in FIGS. 13 to 15, the locking member 55 comprises a base part 58 and a cover 59. As shown in FIG. 6 or FIG. 7, cutaways 60 are provided in the two side walls 54 of the frame 2, and the base parts 58 of the locking members 55 are mounted in the side walls 54 so as to close these cutaways 60. Furthermore, a receiving groove 61 is formed in the base part 58 for mounting the comb-tooth unit 49. Moreover, one lock pin 62 is mounted in the base part 58 so as to maintain the cover 59 in the closed state.

The cover 59 of the locking member 55 is pivotably mounted on the base part 58 by a hinge 63. A hold-down part 64 is integrally formed at the top of the cover 59 so as to project inwardly, in order to prevent the slicing blade 10 and the comb-tooth unit 49 that have been mounted in the frame 2 from coming out. Furthermore, clasp parts 65, 65 are provided in the cover 59 so as to maintain the closed state when the cover 59 has been closed by way of clasping a lock pin 62 therein. That is to say, a single locking pin 62 is clasped by these two clasp parts 65, 65.

When both the slicing blade 10 and the comb-tooth unit 49 are to be fitted in the frame 2, first, the covers 59 of the two locking members 55 are opened. Next, the comb-tooth unit 49 is fitted before the slicing blade 10. If the slicing blade 10 is fitted first, it is not possible to subsequently fit the comb-tooth unit 49. When fitting the comb-tooth unit 49 in the frame 2, it suffices to push the retainer protrusions 53 on the comb-tooth unit 49 into the receiving groove 61. At this time, the top face 69 of the retainer protrusion 53 will be flush with the top face 70 of the base part 58 of the locking member 55. Next, the horizontal plate 66 of the slicing blade 10 is placed on the top faces 70 of the base parts 58 so that the slicing blade 10 bridges the base parts 58 of the two locking members 55. At this time, the extended portions 71 of the horizontal plate 66 are placed on the top face 69 of the retainer protrusions 53. Next, when the covers 59 of both locking members 55 are closed, the hold-down parts 64 thereof hold the horizontal plates 66 of the slicing blade 10 from above, thus reliably locking the slicing blade 10 and the comb-tooth unit 49. When only the slicing blade 10 is mounted, the slicing blade 10 may be locked so as to bridge the base parts 58 of the two locking members 55.

When the slicing blade 10 and the comb-tooth unit 49 are removed, first the covers 59 of the two locking members 55 are opened. At this point, by placing a fingertip in a recess 67 that is formed on the first outer wall 56, the fingertip can be engaged with a finger engagement part 47 of the cover 59, whereby the cover 59 can easily be opened. Next, the slicing blade 10 is removed. The comb-tooth unit 49 cannot be removed unless the slicing blade 10 is removed first. Furthermore, when the first receiving part 3 is in the most lowered state, the front end 78 of the top plate 5 of the first receiving part 3 strikes the step 72 of the comb-tooth unit 49, and presses on the comb-tooth unit 49 from above, so that the forward end 78 of the top plate 5 blocks the comb-tooth unit 48 so that it cannot be removed. Accordingly, when the comb-tooth unit 49 is to be removed, this is preferably performed after raising the first receiving part 3 to the highest position.

Next, the sizes in the present mode of embodiment will be described. The overall length of the slicer 1, including the adjustment knob 48, is approximately 425 mm. The width of the slicer 1, not including the stand 7 and the locking members 55, is approximately 117 mm. The height of the slicer 1, not including the stand 7, is approximately 65 mm. The size is as described above, but it is a matter of course that the present invention is not limited to these numerical values.

Figure 16:
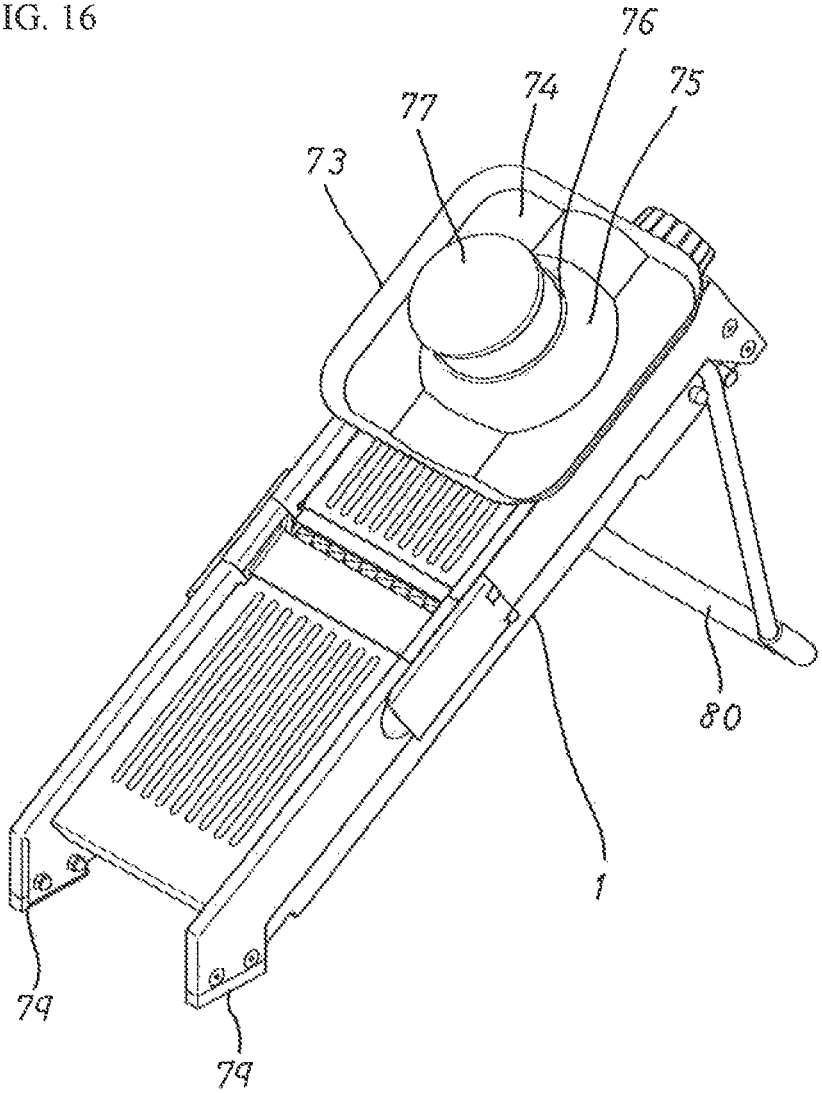
FIG. 16 is a perspective view showing the situation in which a vegetable holder is used.

Note that the present invention can be embodied in various different modes based on the configuration described above. For example, the materials for the frame 2, the second receiving part 4, the base material 12 of the first receiving part 3 and the top plate 5 are not limited to those described above, and it suffices that these be materials with which implementation is possible. Furthermore the present invention can perform slicing using a vegetable holder 73, as shown in FIG. 16. The vegetable holder 73 is provided with a cylindrical portion 75 for inserting vegetables at the center of a base plate 74, and a vegetable insertion hole 76 is provided in this cylindrical portion 75. When a vegetable is sliced, the vegetable is inserted into this vegetable insertion hole 76 and the vegetable holder 73 is slid forward and rearward while pressing down on the vegetable with a pressing member 77. It is possible to prevent harming fingers with the slicing blade 10 or the like by using the vegetable holder 73. Furthermore, this can be used with the stand 7 removed from the frame 2, by way of stretching the stand 7 to the left and the right. Furthermore, the present invention is such that the slicing blade 10 can be vertically mobile by way of securing the slicing blade 10 to the top plate 5 of the first receiving part 3. In this case, the configuration is such that the comb-tooth unit 49 cannot be fitted. If the slicing blade 10 is secured to the top plate 5, the food can be sliced by sliding the food from the top face of the second receiving part to the top face of the first receiving part. In this case, the food first slides across the top face of the second receiving part, and then slides across the top face of the first receiving part. Accordingly, forward and rearward are the reverse of that in the embodiment. Furthermore, in addition to mounting the slicing blade 10 and the comb-tooth unit

49 perpendicularly with respect to the longitudinal direction of the frame 2 as in the embodiment, these may be mounted at an inclination with respect to the longitudinal direction of the frame 2.

The slicer is such that force, which is applied to a mobile first receiving part and/or an adjustment member for moving a slicing blade, is transmitted by the worm of a drive part that is turned, whereby the height of the first receiving part and/or the slicing blade is quickly changed, and even if the food is pressed down during use, the first receiving part and/or the slicing blade will not be lowered.

EXPLANATION OF THE SYMBOLS

1 slicer
2 frame
3 first receiving part
4 second receiving part
5 top plate
6 rear end wall of slicer
7 stand
8 engagement protrusion
9 stopper
10 slicing blade
11 blade edge
12 base member
13 side wall
14 pin
15 guide plate
16 pin
17 pin hole
18 pin hole
19 insertion hole
20 bracket
21 slot
22 bolt
23 nut
24 follower part
25 follower part
26 follower inclined face
27 follower inclined face
28 follower inclined groove
29 follower inclined groove
30 adjustment member
31 driver part
32 driver part
33 driver inclined face
34 driver inclined face
35 protruding piece
36 protruding piece
37 driver engagement protrusion
38 driver engagement protrusion
39 elongate protrusion
40 guide part
41 rear wall
42 drive shaft
43 worm
44 engagement hole
45 groove
46 pin
47 finger engagement part
48 adjustment knob
49 comb-tooth unit
50 guide groove
51 base
52 comb tooth
53 stop protrusion
54 frame sidewall
55 locking member
56 first outer wall
57 second outer wall
58 base part
59 cover
60 cut away
61 receiving groove
62 locking pin
63 hinge
64 hold-down part
65 clasp part
66 horizontal plate
67 recess
68 elongate engagement protrusion
69 top face of retainer protrusion
70 top face of base part
71 extended portion
72 step
73 vegetable holder
74 baseplate
75 cylinder
76 vegetable insertion hole
77 pressing member
78 front edge of top plate
79 contact part
80 anti-slip part

The invention claimed is:

1. A culinary slicer, comprising:

a slicing blade;

a first receiving part;

a second receiving part; and an adjusting member;

a turning mechanism;

a drive shaft;

a frame; and an adjusting knob; and wherein the slicing blade is configured relative to the first receiving part and the second receiving part so that food that is slid forward from an upper surface of the first receiving part towards an upper surface of the second receiving part is sliced by the slicing blade;

wherein the first receiving part is movable vertically by the adjusting member so as to adjust thickness of a slice of the food sliced by the slicing blade;

wherein the adjusting member is movably attached to the frame in a longitudinal direction of the frame;

wherein the turning mechanism is interposed between the adjusting member and the first receiving part and is configured to convert longitudinal movement of the adjusting member to the vertical movement of the first receiving part;

wherein the drive shaft has a worm for moving the adjusting member to achieve said longitudinal movement;

wherein the adjusting knob for rotating the drive shaft is attached to the drive shaft at a rear end of the drive shaft;

wherein the worm is configured to extend less than an entire length of the drive shaft;

wherein between the worm and the adjusting knob is a portion of the drive shaft where there is no worm, said portion being inserted into a shaft hole provided in a rear-end wall of the frame;

wherein the drive shaft is configured to allow rotation of the drive shaft and to preclude longitudinal movement of the drive shaft; and wherein the worm engages with an engaging hole provided on the adjusting member, so that the adjusting member is moved by rotation of the worm.

2. The slicer of claim 1, wherein the turning mechanism comprises a first inclined face provided on the first receiving part and a second inclined face provided on the adjustment member, said first inclined face and said second inclined face being inclined in the vertical direction, and being configured, when facing each other, to slide on each other.

* * * * *